US009188393B2

(12) United States Patent
Fujita et al.

(10) Patent No.: US 9,188,393 B2
(45) Date of Patent: Nov. 17, 2015

(54) MULTISTAGE PRESSURE CONDENSER AND STEAM TURBINE PLANT EQUIPPED WITH THE SAME

(75) Inventors: Issaku Fujita, Tokyo (JP); Satoshi Hiraoka, Tokyo (JP); Jiro Kasahara, Tokyo (JP); Seiho Utsumi, Tokyo (JP); Koichi Tanimoto, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 39 days.

(21) Appl. No.: 13/239,621

(22) Filed: Sep. 22, 2011

(65) Prior Publication Data

US 2012/0216541 A1 Aug. 30, 2012

(30) Foreign Application Priority Data

Feb. 28, 2011 (JP) ..... 2011-043294

(51) Int. Cl.
*F01K 23/06* (2006.01)
*F02M 11/00* (2006.01)
(Continued)

(52) U.S. Cl.
CPC . *F28B 1/02* (2013.01); *F01K 9/003* (2013.01); *F28B 7/00* (2013.01); *F28B 9/02* (2013.01); *F28B 9/08* (2013.01); *F28F 25/087* (2013.01)

(58) Field of Classification Search
CPC ..... F01K 9/00; F01K 9/02; F01K 9/003; F01K 7/12; F28B 1/00; F28B 1/02; F28B 7/00
USPC ..... 60/685–693, 670; 137/255, 262; 261/146, 113, 157, DIG. 10
See application file for complete search history.

(56) References Cited

U.S. PATENT DOCUMENTS 3,157,229 A * 11/1964 Wennerberg ..... 165/167
3,659,623 A * 5/1972 Facius ..... 137/255
(Continued)

FOREIGN PATENT DOCUMENTS

CN 1143329 2/1997
CN 1419038 5/2003
(Continued)

OTHER PUBLICATIONS

AIPN English Translation by machine for Japanese Patent: 2009-052867.*
(Continued)

*Primary Examiner* — Kenneth Bomberg
*Assistant Examiner* — Deming Wan
(74) *Attorney, Agent, or Firm* — Wenderoth, Lind & Ponack, L.L.P.

(57) ABSTRACT

A pressure bulkhead has a plurality of holes and divides a low-pressure chamber at low pressure in the vertical direction. A cooling-tube bank is located in an upper section of the low-pressure chamber and performs heat exchange with low-pressure steam guided to the low-pressure chamber by introducing coolant therein to condense the low-pressure steam to low-pressure steam condensate. A reheat chamber serves as a lower section of the low-pressure chamber and stores the low-pressure steam condensate falling from the holes in the pressure bulkhead. A high-pressure-steam introducing unit introduces high-pressure steam within a high-pressure chamber at high pressure to the reheat chamber. A plurality of plate members are parallel to each other below the pressure bulkhead and extend in a falling direction of the condensate falling from the holes in the pressure bulkhead.

21 Claims, 5 Drawing Sheets

(51) Int. Cl.

| | |
|---|---|
| ***F28B 7/00*** | (2006.01) |
| ***F28B 1/02*** | (2006.01) |
| ***F01K 9/00*** | (2006.01) |
| *F28F 25/08* | (2006.01) |
| *F28B 9/02* | (2006.01) |
| *F28B 9/08* | (2006.01) |

(56) References Cited

U.S. PATENT DOCUMENTS

| | | | | |
|---|---|---|---|---|
| 3,870,485 | A | 3/1975 | Shiraishi et al. | |
| 4,198,215 | A | 4/1980 | Regehr | |
| 4,360,060 | A * | 11/1982 | Collgon | 165/173 |
| 4,598,767 | A | 7/1986 | Saleh | |
| 4,762,650 | A | 8/1988 | Bosman | |
| 4,890,670 | A * | 1/1990 | Schiessl | 165/76 |
| 5,182,925 | A * | 2/1993 | Alvarez et al. | 62/347 |
| 5,316,628 | A * | 5/1994 | Collin et al. | 203/72 |
| 5,671,804 | A * | 9/1997 | Kordelin | 165/46 |
| 5,925,291 | A | 7/1999 | Bharathan et al. | |
| 6,814,345 | B2 | 11/2004 | Inoue | |
| 6,854,278 | B2 * | 2/2005 | Maisotsenko et al. | 62/94 |
| 7,661,662 | B2 * | 2/2010 | Forstmanis | 261/141 |
| 2003/0090010 | A1 | 5/2003 | Inoue | |
| 2005/0034455 | A1 * | 2/2005 | Inoue | 60/685 |
| 2006/0278089 | A1 * | 12/2006 | Theilow | 96/290 |
| 2010/0319879 | A1 | 12/2010 | Sugitani et al. | |

FOREIGN PATENT DOCUMENTS

| | | |
|---|---|---|
| JP | 47-26505 | 10/1972 |
| JP | 49-32002 | 3/1974 |
| JP | 9-511322 | 11/1997 |
| JP | 11-173768 | 7/1999 |
| JP | 2003-148876 | 5/2003 |
| JP | 3706571 | 10/2005 |
| JP | 2009-052867 | 3/2009 |
| JP | 2009-97788 | 5/2009 |

OTHER PUBLICATIONS

International Search Report issued Dec. 6, 2011 in corresponding International (PCT) Application No. PCT/JP2011/071277 with English translation.

Office Action issued May 22, 2014 in corresponding Chinese patent application No. 201180037157.6.

Extended European Search Report issued Feb. 19, 2015 in corresponding European patent application No. 11859853.1.

Decision to Grant a Patent issued Feb. 24, 2015 in corresponding Japanese patent application No. 2011-043294.

Office Action issued Jul. 28, 2014 in corresponding Korean patent application No. 10-2013-7001159 (with English translation).

Decision to Grant a Patent issued Jul. 17, 2015 in corresponding Chinese patent application No. 201180037157.6 (with English translation).

* cited by examiner

MULTISTAGE PRESSURE CONDENSER AND STEAM TURBINE PLANT EQUIPPED WITH THE SAME

CROSS REFERENCE TO RELATED APPLICATIONS

This application claims benefit of Japanese Application No. 2011-043294 filed in Japan on Feb. 28, 2011, the contents of which is hereby incorporated by its reference.

BACKGROUND OF THE INVENTION

1. Field of the Invention

The present invention relates to multistage pressure condensers used in steam turbine plants.

2. Description of Related Art

Generally, in a steam turbine plant, steam that has driven the steam turbine is exhausted from the turbine so as to be guided to a condenser. The steam guided to the condenser exchanges heat with coolant guided to the condenser so as to be condensed into steam condensate. The steam condensate obtained in the condenser is heated via a heater and is supplied to a boiler. The heated steam condensate supplied to the boiler is turned into steam so as to be used as a driving source for the steam turbine.

In such a steam turbine plant, a multistage pressure condenser is used for achieving higher plant efficiency with increasing temperature of the steam condensate guided to the heater from the condenser, as well as for minimizing the amount of coolant used for the heat exchange performed in the condenser.

FIG. 5 schematically illustrates the configuration of, for example, a two-stage pressure condenser constituted of high-pressure and low-pressure condensers.

A low-pressure condenser 2 in a multistage pressure condenser 1 constituted of high-pressure and low-pressure condensers mainly includes a pressure bulkhead 4 that has multiple holes 8 and that partitions a low-pressure drum 3, in the longitudinal direction thereof, into upper and lower sections; a low-pressure cooling-tube bank 5 provided in the upper section of the low-pressure drum 3 and to which coolant is guided; and a reheat chamber 6 located in the lower section of the low-pressure drum 3.

Exhaust (low-pressure exhaust) guided to the upper section of the low-pressure drum 3 from a steam turbine (not shown) exchanges heat with the coolant guided to the low-pressure cooling-tube bank 5 so as to be condensed into low-pressure steam condensate. The low-pressure steam condensate is accumulated above the pressure bulkhead 4 so as to form a condensate pool 7. Since the pressure bulkhead 4 is provided with the plurality of holes 8, the low-pressure steam condensate falls toward the reheat chamber 6 from the condensate pool 7.

The reheat chamber 6 is connected to a steam duct 13 that guides the steam-turbine exhaust to the reheat chamber 6 of the low-pressure condenser 2 from the high-pressure condenser 22. Therefore, the low-pressure steam condensate falling into the reheat chamber 6 makes gas-liquid contact with high-pressure steam guided from the steam duct 13 so as to be reheated. The reheating efficiency becomes higher with increasing gas-liquid contact time between the reheated low-pressure steam condensate and the exhausted high-pressure steam.

In order to increase the gas-liquid contact time, the Publication of Japanese Patent No. 3706571 discloses providing a tray 9 for storing the low-pressure steam condensate falling into the reheat chamber 6 from the multiple holes 8 until the low-pressure steam condensate overflows therefrom, as shown in FIG. 5.

Furthermore, Japanese Unexamined Patent Application, Publication No. 2009-52867 discloses suspending an angle iron element, with its apex oriented upward, or a spiral element from the pressure bulkhead.

Moreover, Japanese Unexamined Patent Application, Publication No. Hei 11-173768 discloses suspending a cylindrical liquid film, extending in the longitudinal direction of the low-pressure drum, into the reheat chamber from the pressure bulkhead.

However, recently, there have been demands to further increase the gas-liquid contact time relative to the inventions disclosed in the Publication of Japanese Patent No. 3706571, Japanese Unexamined Patent Application, Publication No. 2009-52867, and Japanese Unexamined Patent Application, Publication No. Hei 11-173768 so as to achieve higher reheating efficiency.

In the inventions disclosed in the Publication of Japanese Patent No. 3706571, Japanese Unexamined Patent Application, Publication No. 2009-52867, and Japanese Unexamined Patent Application, Publication No. Hei 11-173768 and the case shown in FIG. 5, when the pressure difference between the high-pressure condenser 22 and the low-pressure condenser 2 increases (to, for example, 50 mmHg), the water level of the condensate pool 7 in the low-pressure condenser 2 rises, possibly causing the low-pressure cooling-tube bank 5 located above the pressure bulkhead 4 to become submerged in the condensate pool 7.

Therefore, FIG. 6 shows a measure taken to prevent the low-pressure cooling-tube bank (not shown) from being submerged in the condensate pool 7 by increasing the capacity of the condensate pool 7 by lowering a part 4*a* of the pressure bulkhead 4 in the low-pressure condenser 2 by, for example, about 50 cm toward the reheat chamber 6. However, if the part 4*a* of the pressure bulkhead 4 is lowered toward the reheat chamber 6 in this manner, the distance from the part 4*a* of the pressure bulkhead 4, having the multiple holes 8, to the tray 9 becomes shorter, which is a problem in that the gas-liquid contact time between the falling low-pressure steam condensate and the high-pressure steam becomes shorter, resulting in reduced reheating efficiency.

On the other hand, if the low-pressure cooling-tube bank is provided above and away from the condensate pool without lowering the aforementioned part of the pressure bulkhead toward the reheat chamber, the overall size of the condenser would increase.

BRIEF SUMMARY OF THE INVENTION

In view of the circumstances described above, it is an object of the present invention to provide a multistage pressure condenser and a steam turbine plant equipped with the same that allow for higher reheating efficiency without being increased in size.

In order to solve the aforementioned problems, the present invention employs the following solutions.

A multistage pressure condenser according to a first aspect of the present invention includes a plurality of chambers with different pressures; a pressure bulkhead that has a plurality of holes and that divides a low-pressure chamber, which is one of the chambers at low pressure, in the vertical direction; a cooling-tube bank that is provided in an upper section of the low-pressure chamber partitioned by the pressure bulkhead and that performs heat exchange with low-pressure steam guided to the low-pressure chamber by introducing coolant therein so as to condense the low-pressure steam to low-pressure steam condensate; a reheat chamber that serves as a lower section of the low-pressure chamber partitioned by the pressure bulkhead and that stores the low-pressure steam condensate falling from the holes in the pressure bulkhead; high-pressure-steam introducing means for introducing high-pressure steam within a high-pressure chamber, which is one of the chambers at high pressure, to the reheat chamber; and a plurality of plate members that are arranged parallel to each other below the pressure bulkhead and that extend in a falling direction of the low-pressure steam condensate falling from the holes in the pressure bulkhead. The plate members each have a cross-sectional shape, as viewed in the falling direction of the low-pressure steam condensate, having one or more protrusions and recesses.

The low-pressure steam condensate falling from the holes in the pressure bulkhead makes gas-liquid contact with the high-pressure steam introduced into the reheat chamber. The low-pressure steam condensate is heated more as the gas-liquid contact time becomes longer.

In the present invention, the multiple plate members arranged parallel to each other and extending in the falling direction of the low-pressure steam condensate falling from the holes in the pressure bulkhead are provided below the pressure bulkhead, and the plate members each have a cross-sectional shape, as viewed in the falling direction of the low-pressure steam condensate, having one or more protrusions and recesses. Thus, the contact area between the low-pressure steam condensate falling from the holes in the pressure bulkhead and the plate members can be increased. This can increase the gas-liquid contact time between the high-pressure steam introduced into the reheat chamber and the low-pressure steam condensate. Consequently, the reheating efficiency can be readily increased without having to change the overall size of the multistage pressure condenser.

Furthermore, the use of the plate members reduces the manufacturing costs and simplifies the installation process. Therefore, an increase in the manufacturing costs and the manufacturing time of the multistage pressure condenser can be suppressed.

In the multistage pressure condenser according to the first aspect of the present invention, it is preferable that the distance between the plate members arranged parallel to each other be adjustable.

By making the distance between the plate members adjustable, the liquid film thickness of the low-pressure steam condensate formed between the plate members can be adjusted, whereby the low-pressure steam condensate falling between the plate members can come into contact therewith, and the falling speed can be controlled. Therefore, the gas-liquid contact time and the contact area between the high-pressure steam and the low-pressure steam condensate can be increased. Consequently, the reheating efficiency can be increased without having to change the size of the multistage pressure condenser.

In the multistage pressure condenser according to the first aspect of the present invention, it is preferable that the plate members have multiple holes.

The plate members used are provided with the multiple holes. Thus, the low-pressure steam condensate falling along the plate members can be dispersed into small portions, and the high-pressure steam can also pass through between the plate members. Consequently, the gas-liquid contact area between the high-pressure steam and the low-pressure steam condensate can be increased.

By using (processing) an already available punched metal material for the plate members provided with the multiple holes, the manufacturing costs can be reduced.

In the multistage pressure condenser according to the first aspect of the present invention, it is preferable that the plate members include pocket sections that open toward the low-pressure steam condensate falling along the plate members.

The plate members used are provided with the pocket sections that open toward the falling low-pressure steam condensate. Thus, the low-pressure steam condensate falling along the plate members can be temporarily accumulated in the pocket sections. Therefore, the low-pressure steam condensate in the pocket sections can be stirred and made to fall. Consequently, the gas-liquid contact area between the high-pressure steam and the low-pressure steam condensate can be increased, thereby achieving higher reheating efficiency.

The plate members equipped with the pocket sections are available as ready-made products. Therefore, an increase in the manufacturing costs of the multistage pressure condenser can be suppressed.

In the multistage pressure condenser according to the first aspect of the present invention, a receiving member that stores the low-pressure steam condensate falling from the plate members and allows the low-pressure steam condensate to overflow therefrom is preferably provided below the plate members.

The receiving member that stores the low-pressure steam condensate falling from the plate members and allows the low-pressure steam condensate to overflow therefrom is provided below the plate members. Therefore, the low-pressure steam condensate overflowing and falling from the receiving member creates a circulation flow in the low-pressure steam condensate accumulated in the reheat chamber, so that a large area of the low-pressure steam condensate comes into contact with the high-pressure steam introduced into the reheat chamber. Consequently, the reheating efficiency can be increased.

In the multistage pressure condenser according to the first aspect of the present invention, a part of the pressure bulkhead where the plate members are provided is preferably depressed downward.

When the pressure difference between the high-pressure chamber and the low-pressure chamber increases, the water level of the low-pressure steam condensate condensed by the cooling-tube bank in the low-pressure chamber and accumulated above the pressure bulkhead rises, possibly causing the cooling-tube bank to become submerged.

Therefore, the aforementioned part of the pressure bulkhead where the plate members are provided is depressed downward. Thus, the capacity for storing the low-pressure steam condensate above the pressure bulkhead can be increased while maintaining the distance between the lowest level of the cooling-tube bank and the water surface of the low-pressure steam condensate accumulated above the pressure bulkhead. Furthermore, even though the distance between the pressure bulkhead and the bottom surface of the reheat chamber is reduced due to the pressure bulkhead being depressed downward, the gas-liquid contact time can still be maintained since the plate members provided below the pressure bulkhead each have one or more protrusions and recesses. Consequently, the cooling-tube bank is prevented from being submerged when the pressure difference between the high-pressure chamber and the low-pressure chamber is large, and the reheating efficiency can be maintained without having to change the overall size of the multistage pressure condenser.

A steam turbine plant according to a second aspect of the present invention includes the aforementioned multistage pressure condenser.

A multistage pressure condenser that allows for higher reheating efficiency without having to change its overall size is used. Therefore, the plant efficiency can be improved without having to change the overall layout or the size of the steam turbine plant.

With the multistage pressure condenser according to the present invention and the steam turbine plant equipped with the same described above, the multiple plate members arranged parallel to each other and extending in the falling direction of the low-pressure steam condensate falling from the holes in the pressure bulkhead are provided below the pressure bulkhead, and the plate members each have a cross-sectional shape, as viewed in the falling direction of the low-pressure steam condensate, having one or more protrusions and recesses. Thus, the contact area between the low-pressure steam condensate falling from the holes in the pressure bulkhead and the plate members can be increased. This can increase the gas-liquid contact time between the high-pressure steam introduced into the reheat chamber and the low-pressure steam condensate. Consequently, the reheating efficiency can be readily increased without having to change the overall size of the multistage pressure condenser.

Furthermore, the use of the plate members reduces the manufacturing costs and simplifies the installation process. Therefore, an increase in the manufacturing costs and the manufacturing time of the multistage pressure condenser can be suppressed.

DETAILED DESCRIPTION OF THE INVENTION

{First Embodiment}

A multistage pressure condenser according to the present invention will be described below with reference to FIG. 1.

Figure 1:
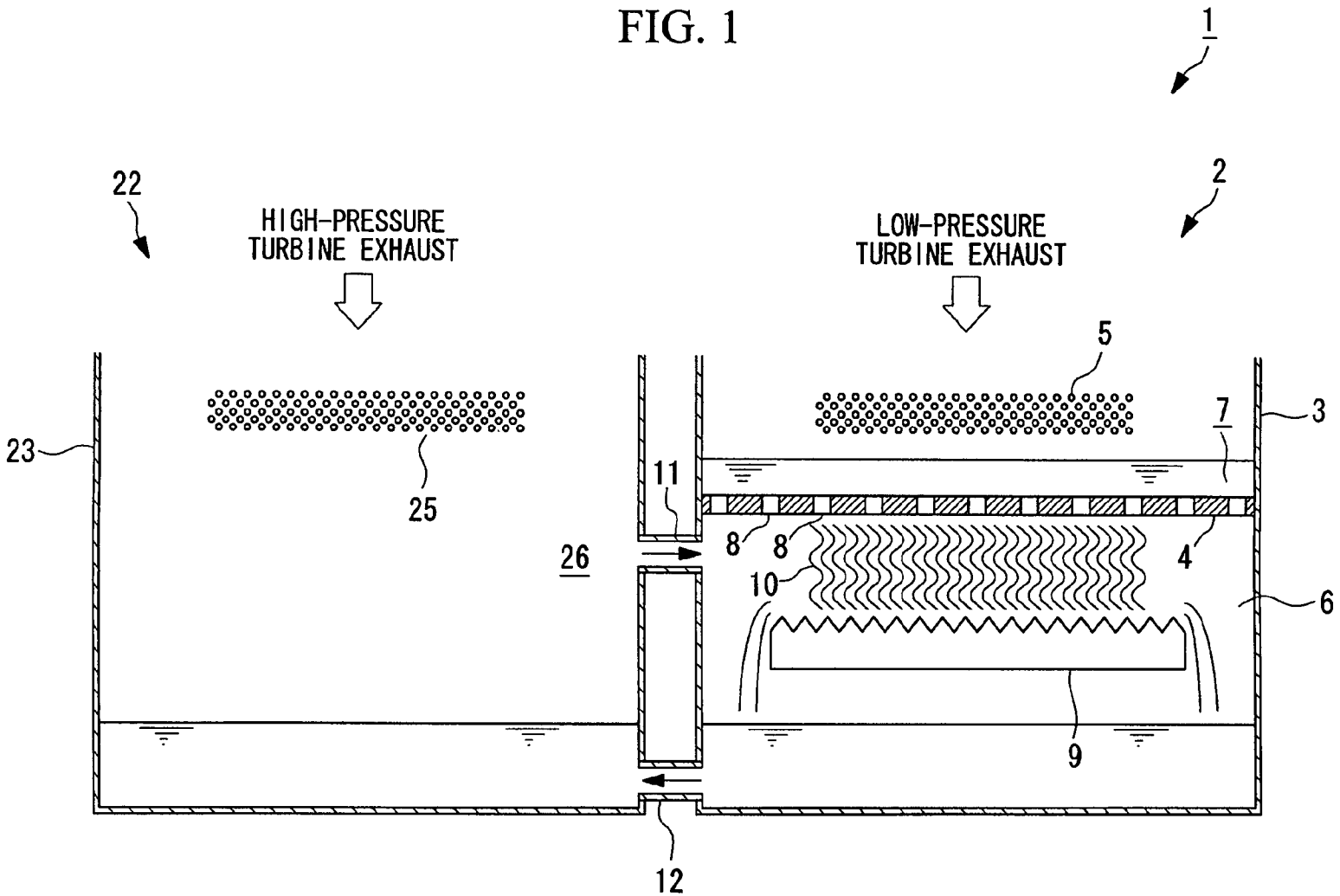
FIG. 1 schematically illustrates the configuration of a multistage pressure condenser according to a first embodiment of the present invention.

FIG. 1 schematically illustrates the configuration of a multistage pressure condenser according to this embodiment.

A steam turbine plant (not shown) having a multistage pressure condenser 1 shown in the drawing is mainly constituted of a steam turbine (not shown), the multistage pressure condenser 1, and a boiler (not shown).

In the steam turbine plant, steam that has expanded and performed work in the steam turbine is introduced into the multistage pressure condenser 1 from the steam turbine and is cooled and condensed in the multistage pressure condenser 1 so as to become steam condensate. The steam condensate obtained in the multistage pressure condenser 1 is heated by a feedwater heater (not shown) and is subsequently supplied to the boiler. The steam condensate supplied to the boiler is turned into steam so as to be used as a driving source for the steam turbine.

As shown in FIG. 1, the multistage pressure condenser 1 has a plurality of chambers with different pressures, and includes a high-pressure condenser (high-pressure chamber) 22 serving as a chamber at high pressure and a low-pressure condenser (low-pressure chamber) 2 serving as a chamber at low pressure.

The high-pressure condenser 22 has a high-pressure drum 23 serving as a chamber at high pressure and a high-pressure cooling-tube bank 25 provided within the high-pressure drum 23.

The low-pressure condenser 2 has a low-pressure drum 3 serving as a chamber at low pressure and a low-pressure cooling-tube bank (cooling-tube bank) 5 provided within the low-pressure drum 3.

The low-pressure condenser 2 is partitioned by a pressure bulkhead 4 that divides the low-pressure condenser 2 in the vertical direction and that has multiple holes 8. The pressure bulkhead 4 is provided such that the distance between the lower surface of the pressure bulkhead 4 and the bottom surface of the low-pressure drum 3 is, for example, 1000 mm. The upper section of the low-pressure condenser 2 partitioned by the pressure bulkhead 4 is provided with the low-pressure cooling-tube bank 5. The lower section of the low-pressure condenser 2 partitioned by the pressure bulkhead 4 is provided with a reheat chamber 6.

Coolant is introduced to the low-pressure cooling-tube bank 5 provided in the upper section of the low-pressure condenser 2. The coolant introduced to the low-pressure cooling-tube bank 5 condenses low-pressure steam that has been guided to the low-pressure condenser 2 into steam condensate (referred to as "low-pressure steam condensate" hereinafter).

The pressure bulkhead 4 is a perforated plate. The multiple holes 8 provided in the pressure bulkhead 4 are falling holes through which the low-pressure steam condensate obtained in the upper section of the low-pressure condenser 2 falls toward the reheat chamber 6.

Corrugated plates (plate members) 10 disposed parallel to the falling direction of the low-pressure steam condensate falling from the holes 8 provided in the pressure bulkhead 4 are provided below (i.e., the reheat chamber 6 side of) the pressure bulkhead 4. A plurality of the corrugated plates 10 are provided, which are arranged parallel to each other.

As shown in FIG. 1, the corrugated plates 10 each have a corrugated cross-sectional shape (zigzag shape), as viewed in the falling direction of the low-pressure steam condensate, having a plurality of (one or more) alternating protrusions and recesses. Specifically, the shape includes leftward and rightward facing projections and recesses that are repeatedly arranged in the vertical direction. For example, the corrugated plates 10 are each formed with a thickness of 3 mm by using stainless steel. The corrugated plates 10 arranged parallel to each other below the pressure bulkhead 4 so as to constitute a corrugated-plate group are arranged with a gap of about 5 mm therebetween, and include, for example, 100 plates.

In the lower section of the reheat chamber 6, a tray (receiving member) 9 is provided below the lower ends of the plurality of corrugated plates 10. The tray 9 is provided such that the distance from the lower surface thereof to the bottom surface of the low-pressure drum 3 is, for example, about 200 mm. The low-pressure steam condensate falls from the corrugated plates 10 onto the tray 9. The low-pressure steam condensate that has fallen on the tray 9 is collected (accumulated) in the tray 9 and then drips downward when it overflows from the tray 9.

Next, the process of how steam is condensed in the multistage pressure condenser 1 having the above-described configuration so as to become steam condensate will be described with reference to FIG. 1.

For example, seawater is supplied as coolant into the low-pressure cooling-tube bank 5 provided within the low-pressure condenser 2. The seawater supplied to the low-pressure cooling-tube bank 5 is delivered to the high-pressure cooling-tube bank 25 of the high-pressure condenser 22 via a connecting pipe (not shown). The seawater delivered to the high-pressure cooling bank 25 is discharged from a discharge tube (not shown).

Low-pressure steam that is discharged after having performed work in the steam turbine is guided to the upper section of the low-pressure condenser 2. The low-pressure steam guided to the upper section of the low-pressure condenser 2 is condensed by being cooled by the low-pressure cooling-tube bank 5 having the seawater introduced therein, thereby becoming low-pressure steam condensate at, for example, about 33° C. The low-pressure steam condensate obtained in this manner is accumulated in the upper section of the low-pressure condenser 2 (i.e., above the pressure bulkhead 4 in FIG. 1) so as to form a condensate pool 7. If the pressure difference between the interior of the high-pressure condenser 22 and the interior of the low-pressure condenser 2 is, for example, 18 mmHg, the distance between the water surface of the condensate pool 7 and the lowest level of the low-pressure cooling-tube bank 5 is equal to a predetermined distance of about 30 cm.

Because the pressure bulkhead 4 is provided with the multiple holes 8, the low-pressure steam condensate accumulated in the condensate pool 7 falls through the holes 8. The low-pressure steam condensate that has fallen (passed) through the holes 8 falls along the surfaces of the multiple corrugated plates 10 provided below the pressure bulkhead 4.

On the other hand, high-pressure steam that is discharged after having performed work in the steam turbine is guided into the high-pressure condenser 22. The high-pressure steam guided to the high-pressure condenser 22 is condensed by being cooled by the high-pressure cooling-tube bank 25 having the seawater introduced therein, thereby becoming steam condensate (referred to as "high-pressure steam condensate" hereinafter) accumulated within the high-pressure condenser 22.

Because the high-pressure condenser 22 and the reheat chamber 6 of the low-pressure condenser 2 are connected to each other via a steam duct (high-pressure-steam introducing means) 11, the high-pressure steam within the high-pressure condenser 22 is introduced into the reheat chamber 6 through the steam duct 11.

The high-pressure steam introduced to the reheat chamber 6 makes gas-liquid contact with the low-pressure steam condensate falling along the surfaces of the corrugated plates 10 from the pressure bulkhead 4. The low-pressure steam condensate falling along the surfaces of the corrugated plates 10 is collected on the tray 9 from the lower ends of the corrugated plates 10.

The low-pressure steam condensate collected on the tray 9 drips downward when it overflows from the tray 9. The low-pressure steam condensate dripping from the tray 9 is accumulated in the reheat chamber 6.

A merging section (not shown) is provided at a lower section of the reheat chamber 6. A connecting pipe 12 connects the merging section to a lower section of the high-pressure condenser 22. The high-pressure steam condensate accumulated in the high-pressure condenser 22 is guided to the merging section via the bypass connecting pipe 12 so as to merge with the low-pressure steam condensate. The merged steam condensate in the merging section is delivered to the feedwater heater by a condensate pump (not shown).

The high-pressure steam condensate can be merged with the steam condensate in the merging section while being maintained at a high temperature. Therefore, high-temperature steam condensate can be delivered from the condensate pump.

In the multistage pressure condenser 1 of this embodiment, since the corrugated plates 10 have multiple protrusions and recesses, the time that it takes the low-pressure steam condensate falling from the multiple holes 8 in the pressure bulkhead 4 to move (fall) along the surfaces of the corrugated plates 10 increases. Therefore, the low-pressure steam condensate falling along the surfaces of the corrugated plates 10 makes gas-liquid contact with the high-pressure steam for a longer period of time. Due to this increase in the gas-liquid contact time between the falling low-pressure steam condensate and the high-pressure steam, the temperature of the low-pressure steam condensate heated by the high-pressure steam becomes higher than that when the corrugated plates 10 are not used.

Furthermore, the low-pressure steam condensate falling onto the tray 9 from the corrugated plates 10 makes gas-liquid contact with the high-pressure steam while being collected by the tray 9 so as to be further heated. The low-pressure steam condensate dripping from the tray 9 creates a circulation flow in the low-pressure steam condensate accumulated in the reheat chamber 6. Therefore, a large surface area of the low-pressure steam condensate comes into contact with the high-pressure steam so that surface turbulent heat transfer occurs, whereby the steam condensate is heated.

Accordingly, due to the longer gas-liquid contact time between the low-pressure steam condensate falling along the surfaces of the corrugated plates 10 and the high-pressure steam, the gas-liquid contact between the low-pressure steam condensate collected by the tray 9 and the high-pressure steam, and the surface turbulent heat transfer between the low-pressure steam condensate overflowing from the tray 9 and the high-pressure steam, good heat transfer is performed, whereby efficiently heated steam condensate is achieved.

Therefore, the steam condensate can be sufficiently heated without having to change the distance by which the low-pressure steam condensate drips downward, that is, the distance between the pressure bulkhead 4 and the bottom surface of the low-pressure drum 3. Consequently, the reheating efficiency can be further improved without having to increase the size of the multistage pressure condenser 1.

As described above, the multistage pressure condenser 1 according to this embodiment and the steam turbine plant equipped with the same exhibit the following advantages.

The 100 (multiple) corrugated plates (plate members) 10 arranged parallel to each other and extending in the falling direction of the low-pressure steam condensate falling from the holes 8 in the pressure bulkhead 4 are provided below the pressure bulkhead 4, and the corrugated plates 10 each have a cross-sectional shape, as viewed in the falling direction of the low-pressure steam condensate, having a plurality of (one or more) protrusions and recesses. Thus, the contact area between the low-pressure steam condensate falling from the holes 8 in the pressure bulkhead 4 and the corrugated plates 10 can be increased. This can increase the gas-liquid contact time between the high-pressure steam introduced into the reheat chamber 6 and the low-pressure steam condensate. Consequently, the reheating efficiency can be readily increased without having to change the overall size of the multistage pressure condenser 1.

The use of the corrugated plates 10 reduces the manufacturing costs and simplifies the installation process. Therefore, an increase in the manufacturing costs and the manufacturing time of the multistage pressure condenser 1 can be suppressed.

The tray (receiving member) 9 that stores the low-pressure steam condensate falling from the corrugated plates 10 and allows the low-pressure steam condensate to overflow therefrom is provided below the lower ends of the corrugated plates 10. Therefore, the low-pressure steam condensate overflowing and falling from the tray 9 creates a circulation flow in the low-pressure steam condensate accumulated in the reheat chamber 6, so that a large area of the low-pressure steam condensate comes into contact with the high-pressure steam introduced into the reheat chamber 6. Consequently, the reheating efficiency can be increased.

The multistage pressure condenser 1 used can improve the reheating efficiency without having to change the overall size thereof. Therefore, the plant efficiency can be improved without having to change the overall layout or the size of the steam turbine plant (not shown).

Although a two-stage condenser having the high-pressure condenser 22 and the low-pressure condenser 2 is used to describe the multistage pressure condenser 1 in this embodiment, the present invention is not limited to this. For example, a three-stage condenser having a high-pressure condenser, an intermediate-pressure condenser, and a low-pressure condenser may be used as an alternative. In this case, corrugated plates are disposed below pressure bulkheads provided in the intermediate-pressure condenser and the low-pressure condenser.

{Second Embodiment}

A multistage pressure condenser according to this embodiment and a steam turbine equipped with the same differ from the first embodiment in that the distance between the corrugated plates is adjustable, but are similar thereto in other points. Therefore, the same components are given the same reference numerals, and descriptions thereof will be omitted.

The distance between the multiple corrugated plates (plate members) provided parallel to each other is adjustable. For example, by changing the distance between the corrugated plates from about 5 mm described in the first embodiment to about 2 mm, the liquid film thickness of the low-pressure steam condensate falling between the corrugated plates can be adjusted so that the falling speed of the low-pressure steam condensate can be reduced.

Since the falling speed of the low-pressure steam condensate falling along the surfaces of the corrugated plates can be reduced without having to change the length of the corrugated plates in the extending direction thereof (i.e., the falling direction of the low-pressure steam condensate), the gas-liquid contact time between the low-pressure steam condensate and the high-pressure steam can be increased without having to change the size of the multistage pressure condenser.

As described above, the multistage pressure condenser according to this embodiment and the steam turbine plant equipped with the same exhibit the following advantages.

By making the distance between the corrugated plates (plate members) adjustable, the liquid film thickness of the low-pressure steam condensate formed between the corrugated plates {Third Embodiment}

A multistage pressure condenser according to this embodiment and a steam turbine equipped with the same differ from the first embodiment in that the corrugated plates have pocket sections that open toward the falling low-pressure steam condensate, but are similar thereto in other points. Therefore, the same components are given the same reference numerals, and descriptions thereof will be omitted.

Figure 2:
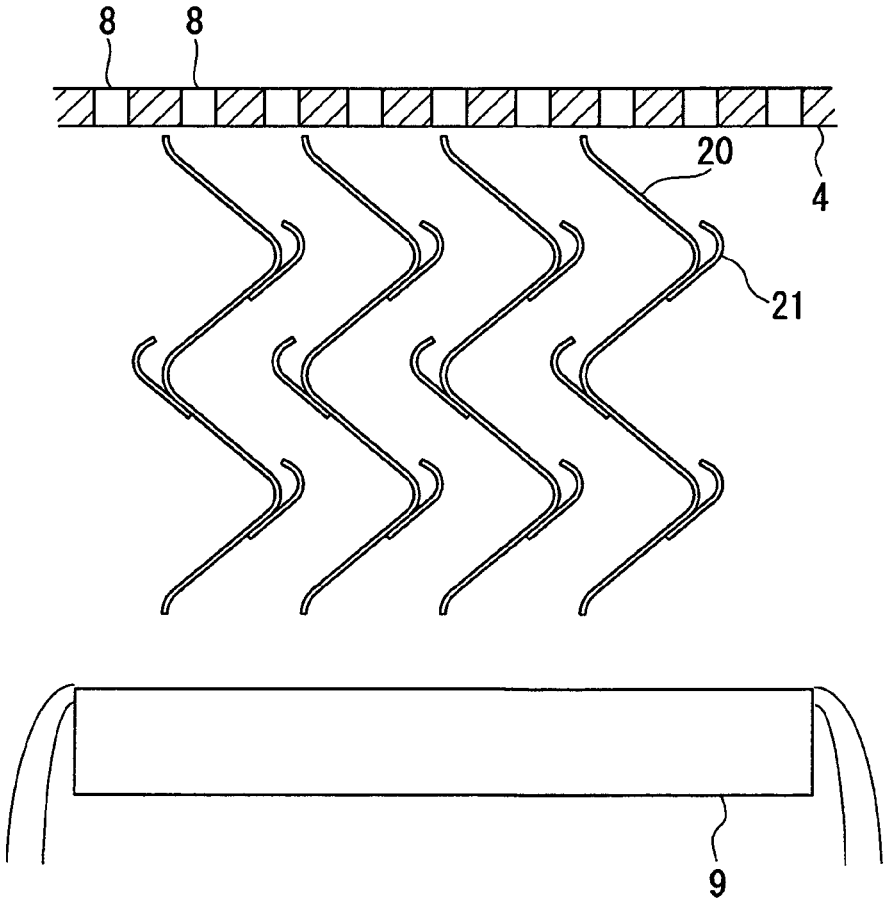
FIG. 2 is a partially enlarged view schematically illustrating the configuration of a low-pressure condenser in a multistage pressure condenser according to a third embodiment of the present invention.

FIG. 2 is a partially enlarged view schematically illustrating the configuration of a low-pressure condenser in the multistage pressure condenser according to this embodiment.

Corrugated plates 20 each have a corrugated cross-sectional shape (zigzag shape), as viewed in the falling direction of the low-pressure steam condensate, having a plurality of (one or more) alternating protrusions and recesses. Moreover, as shown in FIG. 2, the protrusions in the corrugated shape have pocket sections 21 that open toward the low-pressure steam condensate falling along the surfaces of the corrugated plates 20.

The low-pressure steam condensate falling along the surfaces of the corrugated plates 20 from the holes 8 provided in the pressure bulkhead 4 reaches the protrusions in the corrugated shape. Since the protrusions are provided with the pocket sections 21 that open in the falling direction of the low-pressure steam condensate, the low-pressure steam condensate flows into the pocket sections 21.

The low-pressure steam condensate accumulated in the pocket sections 21 overflows from the pocket sections 21 so as to fall along the surfaces of the recesses below the pocket sections 21 of the corrugated plates 20. In this manner, the low-pressure steam condensate falling from the holes 8 provided in the pressure bulkhead 4 is repeatedly guided to the pocket sections 21 from the surfaces of the protrusions of the corrugated plates 20 and overflows from the pocket sections 21 so as to fall along the surfaces of the recesses, thereby ultimately dripping onto the tray (receiving member) 9.

The low-pressure steam condensate guided to the pocket sections 21 from the surfaces of the protrusions of the corrugated plates 20 stirs the low-pressure steam condensate accumulated in the pocket sections 21. Therefore, the contact area between the low-pressure steam condensate and the high-pressure steam increases. Consequently, good heat transfer is achieved, whereby the low-pressure steam condensate falling along the corrugated plates 20 can be efficiently heated.

As described above, the multistage pressure condenser according to this embodiment and the steam turbine plant equipped with the same exhibit the following advantages.

Because the corrugated plates (plate members) 20 used are equipped with the pocket sections 21 that open toward the falling low-pressure steam condensate, the low-pressure steam condensate falling along the corrugated plates 20 can be temporarily accumulated in the pocket sections 21. Therefore, the low-pressure steam condensate in the pocket sections 21 can be stirred and made to fall. Consequently, the gas-liquid contact area between the high-pressure steam and the low-pressure steam condensate can be increased.

Furthermore, the corrugated plates 20 equipped with the pocket sections 21 are available as ready-made products. Therefore, an increase in the manufacturing costs of the multistage pressure condenser (not shown) can be suppressed.

{Fourth Embodiment}

A multistage pressure condenser according to this embodiment and a steam turbine equipped with the same differ from the first embodiment in that a part of the pressure bulkhead where the corrugated plates are provided is depressed downward, but are similar thereto in other points. Therefore, the same components are given the same reference numerals, and descriptions thereof will be omitted.

Figure 3:
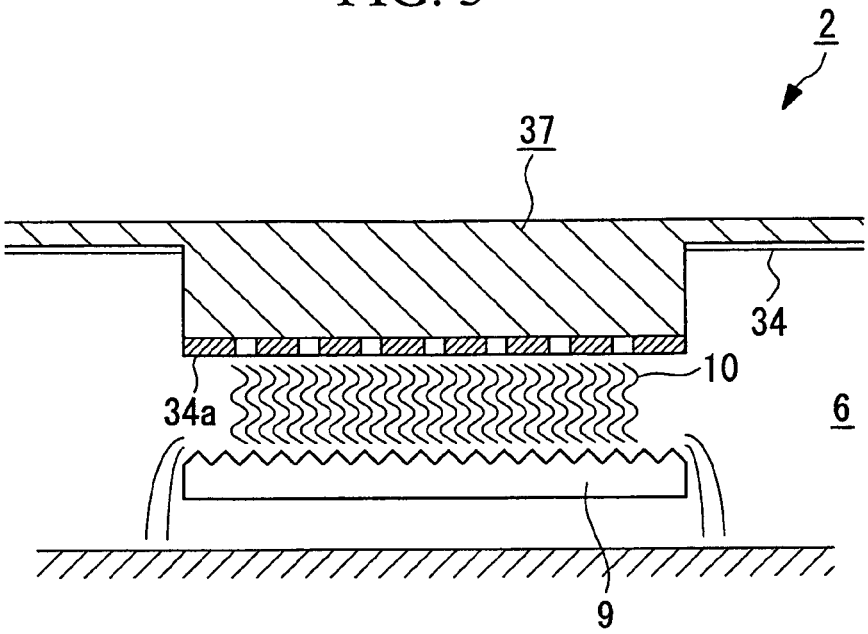
FIG. 3 is a partial view schematically illustrating the configuration of a low-pressure condenser in a multistage pressure condenser according to a fourth embodiment of the present invention.

FIG. 3 is a partial view schematically illustrating the configuration of a low-pressure condenser in the multistage pressure condenser according to this embodiment.

In a pressure bulkhead 34, a part 34*a* thereof where the corrugated plates (plate members) 10 are provided is depressed downward so as to form a condensate pool 37. Assuming that the distance between the pressure bulkhead 34 and the bottom surface of a low-pressure drum (not shown) is, for example, 1000 mm, the part 34*a* of the pressure bulkhead 34 is depressed downward to, for example, about 500 mm.

When the pressure difference between the high-pressure condenser (high-pressure chamber) and the low-pressure condenser (low-pressure chamber) 2 constituting the multistage pressure condenser (not shown) increases (to, for example, 50 mmHg), the amount of low-pressure steam condensate accumulated above the pressure bulkhead 34 increases. The increased low-pressure steam condensate accumulates in the part 34*a* of the pressure bulkhead 34 so as to form the condensate pool 37. Therefore, the distance between the lowest level of the low-pressure cooling-tube bank (cooling-tube bank) and the water surface of the condensate pool 37 can be maintained at a predetermined value (about 30 cm).

Consequently, the low-pressure cooling-tube bank (not shown) is prevented from being submerged in the low-pressure steam condensate accumulated above the pressure bulkhead 34 when the amount of low-pressure steam condensate increases due to an increase in the pressure difference between the high-pressure condenser (not shown) and the low-pressure condenser 2.

Furthermore, the multiple corrugated plates 10 are provided below the part 34*a* of the pressure bulkhead 34 that forms the condensate pool 37. Therefore, even though the length of the corrugated plates 10 in the extending direction thereof (i.e., the falling direction of the low-pressure steam condensate) is reduced due to the part 34*a* of the pressure bulkhead 34 being depressed downward, the gas-liquid contact time between the low-pressure steam condensate and the high-pressure steam can still be increased, as compared with a case where the corrugated plates 10 are not provided, so that the low-pressure steam condensate can be heated.

As described above, the multistage pressure condenser according to this embodiment and the steam turbine plant equipped with the same exhibit the following advantages.

In the pressure bulkhead 34, the part 34*a* of the pressure bulkhead 34 below which the corrugated plates (plate members) 10 are provided is depressed downward. Therefore, the capacity of the condensate pool 37 that stores the low-pressure steam condensate accumulated above the pressure bulkhead 34 can be increased. With the part 34*a* of the pressure bulkhead 34 being depressed downward, even though the distance between the part 34*a* of the pressure bulkhead 34 and the bottom surface of the reheat chamber 6 becomes shorter, the gas-liquid contact time can be maintained since the corrugated plates 10 provided below the part 34*a* of the pressure bulkhead 34 have a plurality of (one or more) protrusions and recesses. Consequently, the low-pressure cooling-tube bank (cooling-tube bank) is prevented from being submerged when the pressure difference between the high-pressure condenser (high-pressure chamber) and the low-pressure condenser (low-pressure chamber) 2 is large, and the reheating efficiency can be maintained without having to change the overall size of the multistage pressure condenser (not shown).

{Fifth Embodiment}

A multistage pressure condenser according to this embodiment and a steam turbine equipped with the same differ from the fourth embodiment in that the corrugated plates have multiple holes, but are similar thereto in other points. Therefore, the same components are given the same reference numerals, and descriptions thereof will be omitted.

Figure 4:
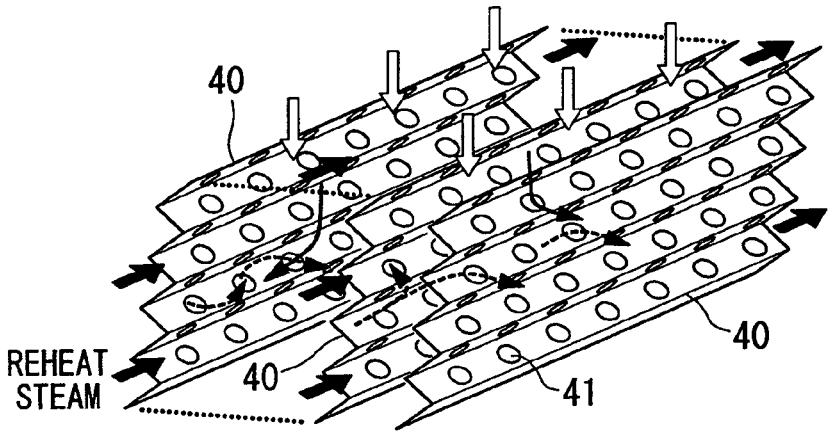
FIG. 4 is a perspective view illustrating corrugated plates of a low-pressure condenser in a multistage pressure condenser according to a fifth embodiment of the present invention.
Figure 5:
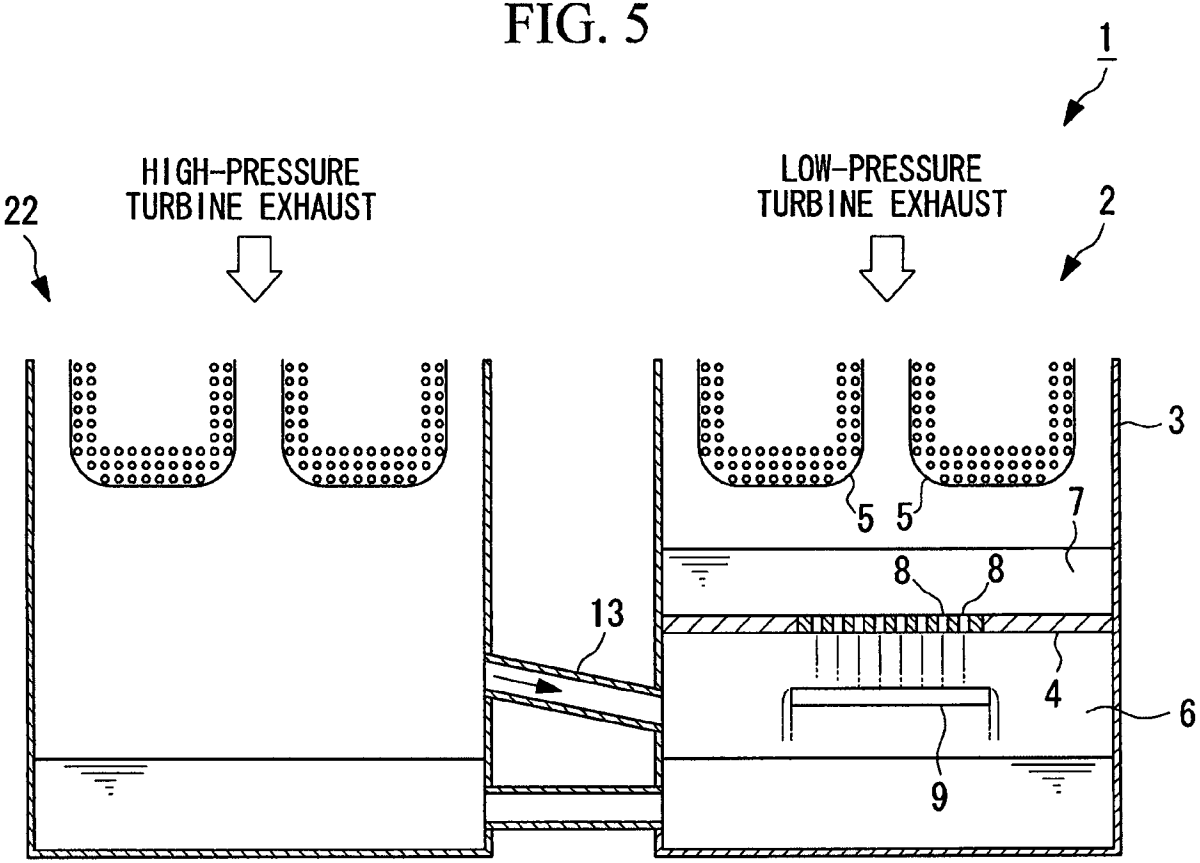
FIG. 5 schematically illustrates the configuration of a multistage pressure condenser in the related art.
Figure 6:
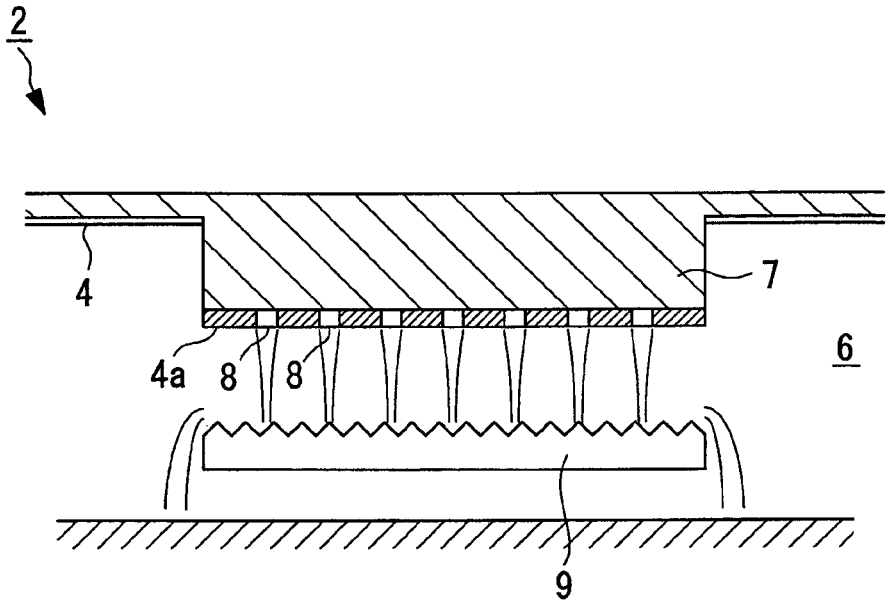
FIG. 6 schematically illustrates the configuration of a modification of a low-pressure condenser in the multistage pressure condenser shown in FIG. 5.

FIG. 4 is a perspective view illustrating corrugated plates of a low-pressure condenser in the multistage pressure condenser according to this embodiment.

Corrugated plates 40 each have a corrugated cross-sectional shape (zigzag shape), as viewed in the falling direction (indicated by hollow arrows in FIG. 4) of the low-pressure steam condensate, having a plurality of (one or more) alternating protrusions and recesses, and also have multiple holes 41 in the surfaces of the protrusions and the recesses, as shown in FIG. 4.

The low-pressure steam condensate falling along the surfaces of the corrugated plates 40 from holes provided in the part 34a (see FIG. 3) of the pressure bulkhead 34 reaches the surfaces of the corrugated plates 40. Since the surface of each corrugated plate 40 have the holes 41, some of the low-pressure steam condensate falls along the surface of the corrugated plate 40, while the rest of the low-pressure steam condensate is dispersed by the holes 41 and flows onto the surface of the neighboring corrugated plate 40.

After repeating this, the low-pressure steam condensate drips onto the tray (receiving member) 9 (see FIG. 3).

The low-pressure steam condensate falling into the holes 41 in each corrugated plate 40 is dispersed into small portions at the surface of the neighboring corrugated plate 40. As indicated by dashed arrows in FIG. 4, the high-pressure steam also passes through the holes 41. Therefore, the contact area between the low-pressure steam condensate and the high-pressure steam increases. Consequently, good heat transfer is achieved, whereby the low-pressure steam condensate falling along the corrugated plates 40 can be efficiently heated.

As described above, the multistage pressure condenser according to this embodiment and the steam turbine plant equipped with the same exhibit the following advantages.

Because the corrugated plates (plate members) 40 used are provided with the multiple holes 41 facing toward the falling low-pressure steam condensate, the low-pressure steam condensate falling along the corrugated plates 40 can be dispersed into small portions, and the high-pressure steam can also pass through between the corrugated plates 40. Consequently, the gas-liquid contact area between the high-pressure steam and the low-pressure steam condensate can be increased.

By using (processing) an already available punched metal material for the corrugated plates 40 provided with the holes 41, the manufacturing costs can be reduced.

The present invention is not to be limited to the above-described embodiments, and various modifications are permissible so long as they do not depart from the spirit of the invention.

What is claimed is:

1. A multistage pressure condenser comprising:

a low-pressure chamber for operating at low pressure;

a high-pressure chamber for operating at high pressure;

a pressure bulkhead that has a plurality of holes and that divides the low-pressure chamber in a vertical direction into an upper section and a lower section;

a cooling-tube bank that is provided in the upper section of the low-pressure chamber and is configured to perform heat exchange with low-pressure steam guided to the low-pressure chamber by introducing coolant therein so as to condense the low-pressure steam to low-pressure steam condensate;

a steam duct configured to convey high pressure steam from the high-pressure chamber to the low-pressure chamber to reheat the low-pressure chamber; and a plurality of corrugated plate members that are arranged parallel to each other below a part of the pressure bulkhead and that extend in a falling direction of the low-pressure steam condensate falling from the holes in the pressure bulkhead, wherein the lower section of the low-pressure chamber is a reheat chamber that is configured to store the low-pressure steam condensate falling from the holes in the pressure bulkhead, wherein the corrugated plate members each have a corrugated shape including at least one protrusion and at least one recess disposed alternately in the vertical direction, the at least one protrusion and at least one recess protruding and being recessed respectively in a horizontal direction perpendicular to the vertical direction, wherein adjacent ones of the corrugated plate members are arranged with a continuous predetermined gap therebetween, and a distance between the adjacent corrugated plate members is the same, wherein said part of the pressure bulkhead is depressed downward to form a condensate pool, and the holes are provided only in said part of the pressure bulkhead, and wherein the adjacent corrugated plate members are arranged away from each other at a distance to allow the low-pressure steam condensate falling from the holes to contact both of the adjacent corrugated plate members to form a liquid film therebetween.

2. The multistage pressure condenser of claim 1, wherein the distance between the corrugated plate members arranged parallel to each other is adjustable.

3. The multistage pressure condenser of claim 1, wherein the corrugated plate members have multiple holes.

4. The multistage pressure condenser of claim 1, wherein the corrugated plate members include pocket sections that open toward the low-pressure steam condensate falling along the corrugated plate members.

5. The multistage pressure condenser of claim 4, wherein an opening of each of the pocket sections extends from a lower position of each of the corrugated shapes.

6. The multistage pressure condenser of claim 1, further comprising a tray configured to store the low-pressure steam condensate falling from the corrugated plate members and allow the low-pressure steam condensate to overflow therefrom, the tray being disposed below the corrugated plate members.

7. The multistage pressure condenser of claim 1, wherein a part of the pressure bulkhead where the corrugated plate members are provided is depressed downward.

8. The multistage pressure condenser of claim 7, wherein the part of the pressure bulkhead which is depressed is a central part of the pressure bulkhead and forms the lowest surface of the pressure bulkhead.

9. The multistage pressure condenser of claim 1, wherein the steam duct extends horizontally between the low-pressure chamber and the high-pressure chamber.

10. The multistage pressure condenser of claim 1, wherein the distance between the adjacent corrugated plate members can be varied between 2 mm to 5 mm.

11. A multistage pressure condenser comprising:

a low-pressure chamber for operating at low pressure;

a high-pressure chamber for operating at high pressure;

a pressure bulkhead that has a plurality of holes and that divides the low-pressure chamber in a vertical direction into an upper section and a lower section;

a cooling-tube bank that is provided in the upper section of the low-pressure chamber and is configured to perform heat exchange with low-pressure steam guided to the low-pressure chamber by introducing coolant therein so as to condense the low-pressure steam to low-pressure steam condensate;

a steam duct configured to convey high pressure steam from the high-pressure chamber to the low-pressure chamber to reheat the low-pressure chamber; and a plurality of corrugated plate members that are arranged parallel to each other below a part of the pressure bulkhead and that extend in a falling direction of the low-pressure steam condensate falling from the holes in the pressure bulkhead, wherein the lower section of the low-pressure chamber is a reheat chamber that is configured to store the low-pressure steam condensate falling from the holes in the pressure bulkhead, wherein the corrugated plate members each have a corrugated shape including at least one protrusion and at least one recess disposed alternately in the vertical direction, the at least one protrusion and at least one recess protruding and being recessed respectively in a horizontal direction perpendicular to the vertical direction, wherein adjacent ones of the corrugated plate members are arranged with a continuous predetermined gap therebetween, wherein the corrugated plate members include pocket sections that open toward the low-pressure steam condensate falling along the corrugated plate members, wherein the pocket sections extend outwardly from the protrusions, respectively, in the horizontal direction and are configured such that the low-pressure steam condensate falling from the holes in the pressure bulkhead flows into the pocket sections, wherein said part of the pressure bulkhead is depressed downward to form a condensate pool, and the holes are provided only in said part of the pressure bulkhead, and wherein the adjacent corrugated plate members are arranged away from each other at a distance to allow the low-pressure steam condensate falling from the holes to contact both of the adjacent corrugated plate members to form a liquid film therebetween.

12. The multistage pressure condenser of claim 11, wherein the distance between the corrugated plate members arranged parallel to each other is adjustable.

13. The multistage pressure condenser of claim 11, wherein the corrugated plate members have multiple holes.

14. The multistage pressure condenser of claim 11, further comprising a tray configured to store the low-pressure steam condensate falling from the corrugated plate members and allow the low-pressure steam condensate to overflow therefrom, the tray being disposed below the corrugated plate members.

15. The multistage pressure condenser of claim 11, wherein a part of the pressure bulkhead where the corrugated plate members are provided is depressed downward.

16. The multistage pressure condenser of claim 15, wherein the part of the pressure bulkhead which is depressed is a central part of the pressure bulkhead and forms the lowest surface of the pressure bulkhead.

17. The multistage pressure condenser of claim 11, wherein the pocket sections contact and extend from lower halves of the protrusions, respectively.

18. The multistage pressure condenser of claim 11, wherein the distances between the adjacent corrugated plate members are equal.

19. The multistage pressure condenser of claim 11, wherein the steam duct extends horizontally between the low-pressure chamber and the high-pressure chamber.

20. The multistage pressure condenser of claim 11, wherein each corrugated plate has a first end and a second end spaced apart from the first end in the vertical direction, wherein the steam duct has an outlet disposed between the first ends and the second ends of the corrugated plates in the vertical direction, and wherein the steam duct is configured to convey steam into the low-pressure chamber in a direction perpendicular to the falling direction of the low-pressure steam condensate falling from the holes in the pressure bulkhead.

21. The multistage pressure condenser of claim 11, wherein the distance between the adjacent corrugated plate members can be varied between 2 mm to 5 mm.

* * * * *